United States Patent [19]

Davis

[11] 4,032,131

[45] June 28, 1977

[54] METHOD AND MEANS FOR FABRICATING MAGAZINES

[76] Inventor: William F. Davis, P.O. Box 179, Hightstown, N.J. 08520

[22] Filed: May 15, 1974

[21] Appl. No.: 470,141

[52] U.S. Cl. ..... 270/53

[51] Int. Cl.[2] ..... B42B 2/00

[58] Field of Search ..... 270/37, 52, 53; 112/21; 226/113, 124; 93/14, 18; 53/180; 281/21

[56] References Cited

UNITED STATES PATENTS

| | | | |
|---|---|---|---|
| 1,336,445 | 4/1920 | Sheldon | 270/37 |
| 1,525,969 | 2/1925 | Waterworth | 270/68 A |
| 1,905,446 | 4/1933 | Dewey | 226/113 |
| 2,149,366 | 3/1939 | Seaman | 270/37 |
| 3,084,841 | 4/1963 | Hata | 226/124 |
| 3,219,338 | 11/1965 | Kastner | 270/31 |
| 3,237,934 | 3/1966 | Rosenberg | 270/37 |
| 3,743,567 | 7/1973 | Abler | 226/113 |

*Primary Examiner*—Edgar S. Burr
*Assistant Examiner*—A. Heinz

[57] ABSTRACT

Novel, new means of the present invention for controllably guiding a plurality of webs is provided to cooperate with other equipments resulting in an unexpected new, novel and ameliorated method of fabricating magazines with continuously driven webs by stopping a portion of the collected plurality of webs for a sufficient duration of time to permit conjoining the webs with each other and subsequently severing and folding the web material at the continuous driven web rate.

18 Claims, 9 Drawing Figures

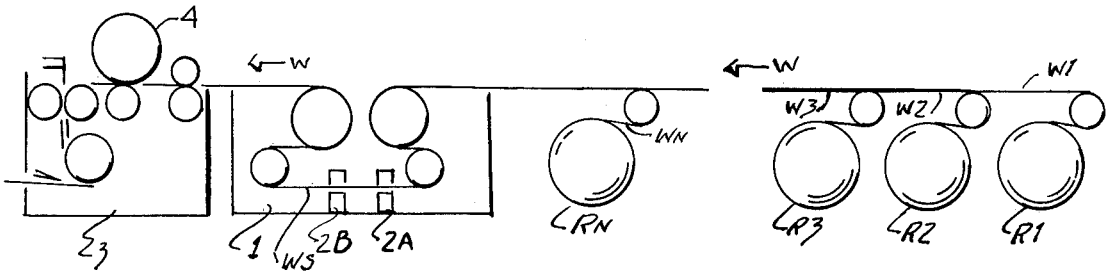
FIGURE I
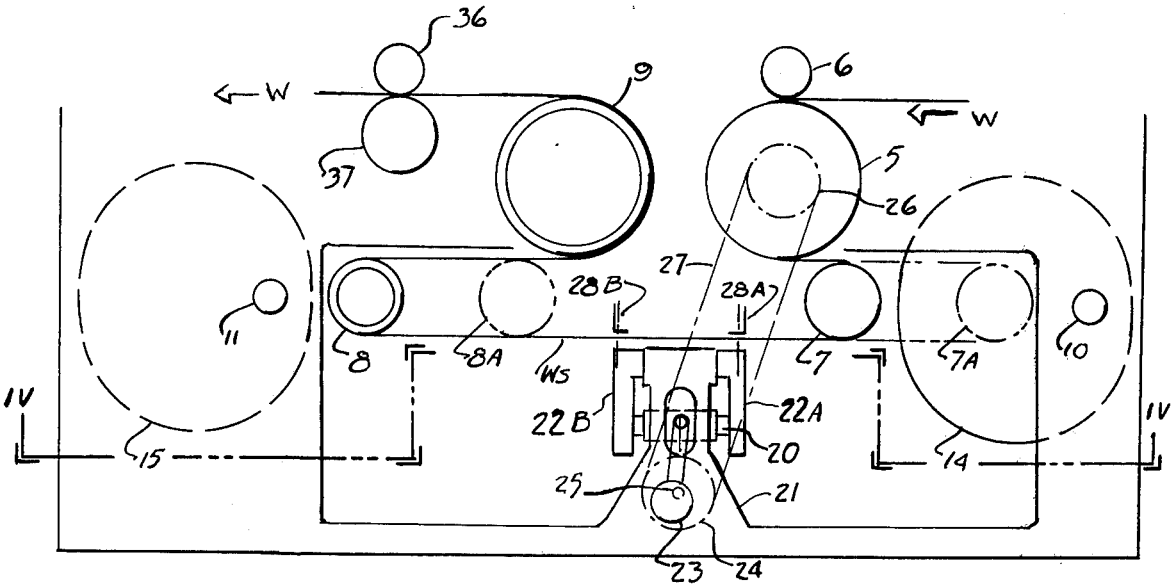
FIGURE II
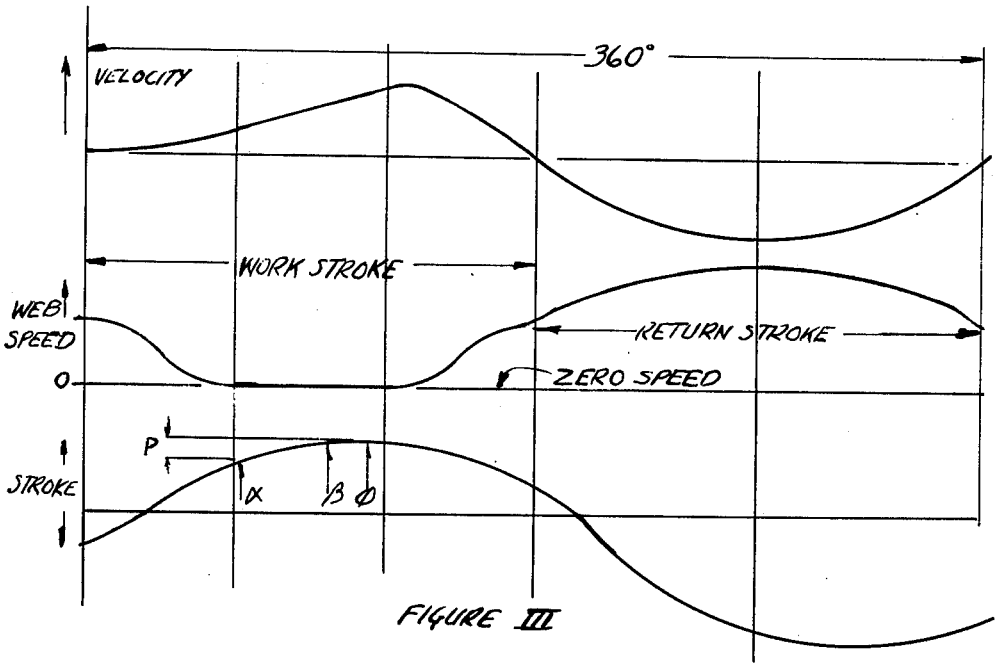
FIGURE III

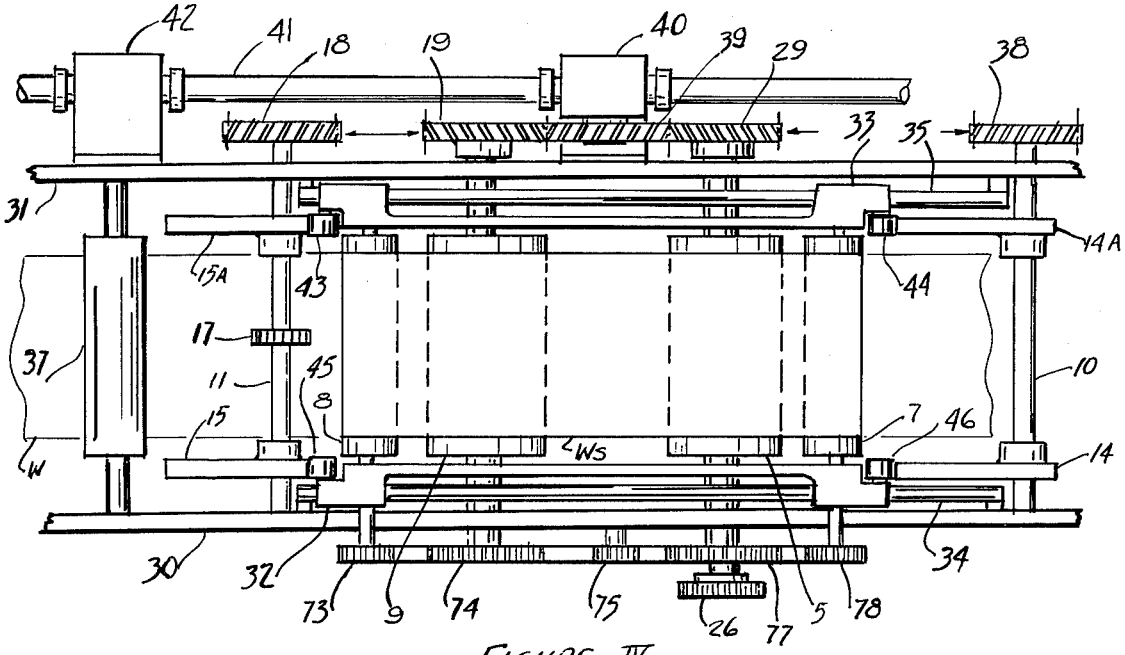
FIGURE IV
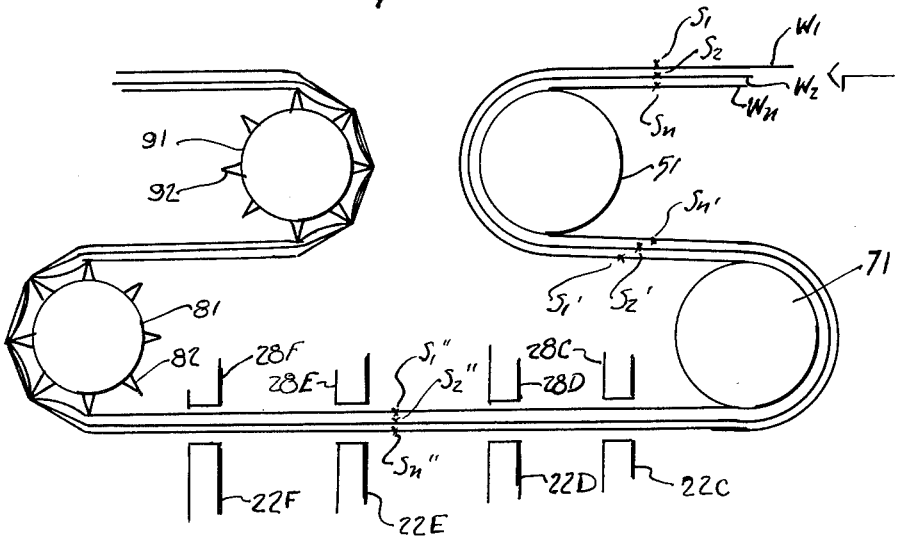
FIGURE V
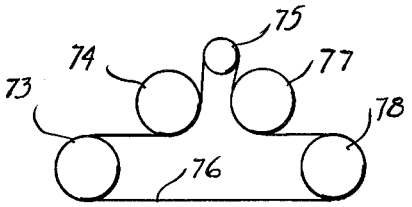
FIGURE VI

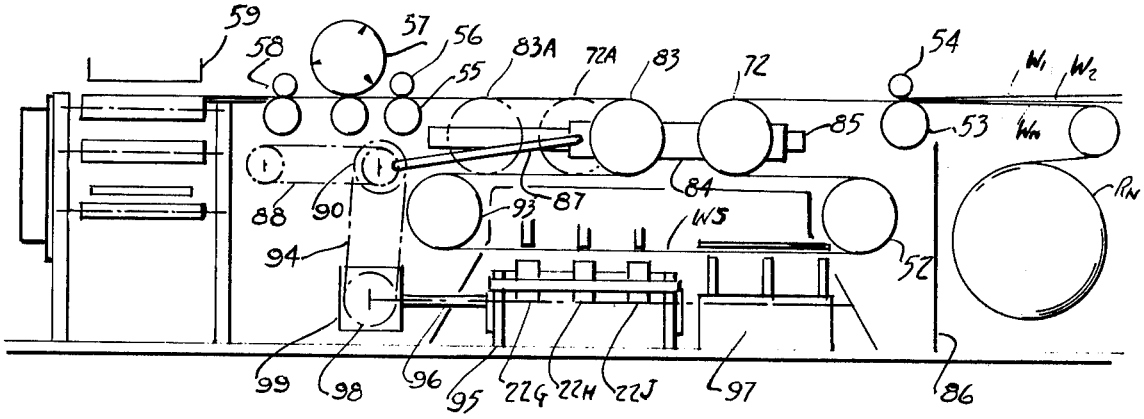
FIGURE VII
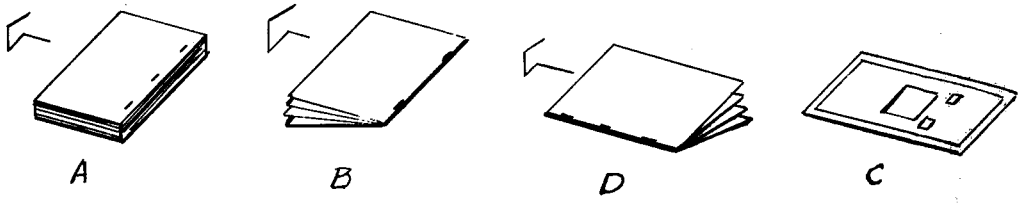
FIGURE VIII
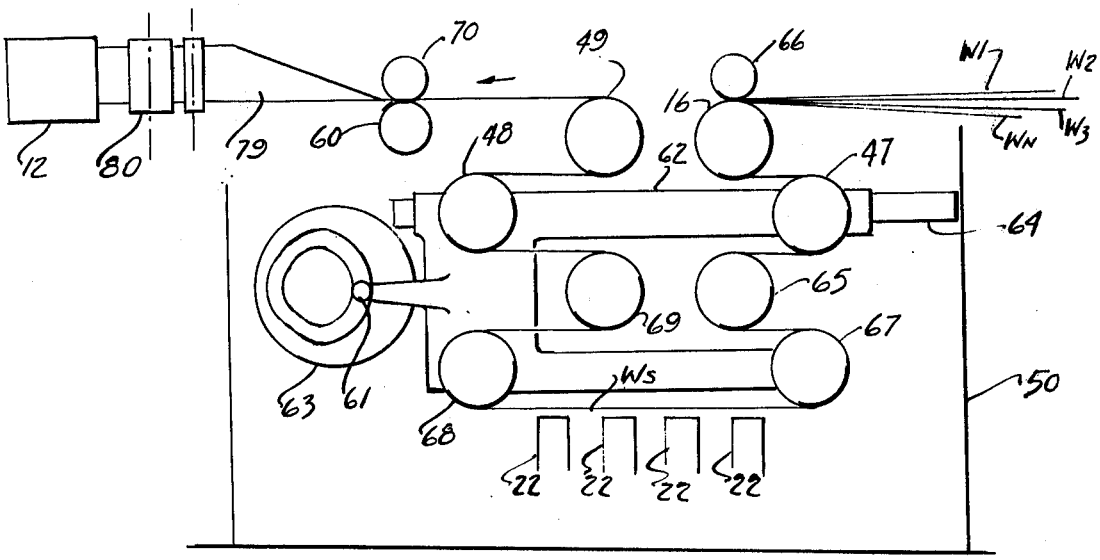
FIGURE IX

METHOD AND MEANS FOR FABRICATING MAGAZINES

The present invention relates to new, novel and useful improvements in the method or and the means for fabricating magazines and like products.

In this disclosure and claims the term "magazine" is employed generically and should be understood to include all publications, catalogs, newspaper supplements, blank books, brochures, papers, books, pamphlets and the like products.

Objects and advantages of the invention will be set forth in part hereinafter and in part will be obvious herefrom, or may be learned by practice with the invention, the same being realized and attained by the instrumentalities and combinations pointed out in the appended claims.

The invention consist in novel parts, constructions, arrangements, combinations and improvements herein disclosed and described.

The accompanying drawings, referred to herein and constituting a part hereof, illustrate the embodiments of the invention, and together with the description serve to explain the principles of the invention.

The present invention has for its object the provision of novel and improved method of fabricating magazines, and the means to accomplish this new and improved method of fabricating magazines.

The prime object of the present invention is to provide a method of fabricating magazines from webs, which may be preprinted.

A second object of the present invention is to provide means to fabricate magazines from webs in a continuous operation.

Another object of the present invention is to provide means for fabricating magazines at very high production rates which has not been possible heretofore.

A further object of the present invention resides in fabricating magazines with a minimum of waste and greater efficiency of the complete manufacturing process.

A still further object of the present invention is to improve the quality of the products and to provide control in the fabricating of the products to effect still further reduction of consumed materials.

Other objects and advantages of the invention will be apparent to those skilled in the art.

While the invention is susceptible of various modifications and alternate constructions and uses, I have depicted in the drawings and disclosed in detail herein preferred embodiments of the invention.

It is to be understood, however, that the broader aspects of the invention are not limited to the specific mechanism shown and described but departures may be made therefrom within the spirit and the scope of the accompanying claims without sacrificing the concommitant benefits and advantages. Therefore, I do not intend to limit the invention by the aformentioned drawings and description but intend to cover all modifications and alternate constructions falling within the spirit and scope of the invention as expressed in the appended claims. Referring to the drawings:

FIG. I is a diagrammatic illustration of the present invention with cooperating machinery.

FIG. II is an illustrative elevation of the present invention arranged with machinery for laterally binding webs.

FIG. III presents illustrative motion diagrams disclosing interaction of functions or the present invention.

FIG. IV is an illustrative stretch out type presentation of the present invention taken along line IV—IV of FIG. II.

FIG. V is a descriptive illlustration depicting control of webs with the present invention.

FIG. VI is a schematic illustration of the roll drive of the present invention.

FIG. VII is a diagrammatic illustration of the present invention arranged with machinery for longitudinally binding and other processing of webs.

FIG. VIII illustrates products which may be fabricated with the equipment of the present invention.

FIG. IX is a diagrammatic presentation of another construction of the present invention for fabricating magazines at very high productive rates.

It is understood that the foregoing description and the following detailed description as well are exemplary and explanatory of the invention but are not restrictive thereof.

BACKGROUND

The practice of fabricating magazines after the pages are printed comprises folding the printed material into multipage signatures; stacking such signatures and transporting them to gathering and bindery machines which associate the various signatures of the magazine and bind them together; unstacking the signatures, transferring them to the hoppers of the gathering machine, feeding the signatures, opening the folded signatures, transferring the signatures to collating conveyors and transporting the associated and collated signatures to means which verifies if all signatures are indeed collected or if additional duplicate signatures have been collected and then binding the collected signatures together.

This process, inherently is plagued with a multiplicity of limitations, problems, ineffeciencies and waste ranging from defective signatures as caused by inaccurate folding, and the multiplicity of handling and transportation of signatures; signatures missed in segregating and transfer of signatures from their respective hoppers, and in transfer to the collating conveyors. These and associated factors contribute to repeated machine stops; defective magazines and product waste; limited reliability due to the multiplicity of operations and functions as generally described in the foregoing and the problems of adjusting the machinery to handle signatures of varying and different size, weight of paper, page composition, kind of paper, etc., and to low speed and interrupted production complimented with excessive manning.

Another manufacturing method is prevalent in the production of newspaper suppliements. The fabrication of newspaper supplements is accomplished by direct processing of the webs as they are printed by utilizing rotary stitching machinery. The production of magazines in this manner, however, is limited by the stitching machinery which has the capability to bind only products with a very low number of pages, in the order of 24 to 32 pages of limited weight and grades of paper such as roto and news stock. Further, experience with such machinery and quality inspection of the product produced discloses a relatively high number of missed stapled and non-uniformity of location of staples in the magazines. Still further the positioning of the staples is fixed and cannot be adjustably positioned to accommodate a range of production needs.

Still further, web stitching, in addition to the foregoing limitations is also only capable of stitching transversely across the running direction of the webs. There exists great need to bind webs in the running or longitudinal direction as evidenced by a vast number of web offset printing presses which produce printed images which must be bound in the running direction.

SUMMARY OF THE PRESENT INVENTION

A plurality of webs are continuously driven, collated, registered, bound, severed into packets and folded into magazines or similar products. The invention provides means to stop a portion of the continuously driven webs for a sufficient period of time to permit processing and to do this with the webs held in register, under control and with tension. Further the invention provides the combination of said means in cooperation with web supply and severing-folding means to produce magazines at very high speed in a continuous process.

TYPICAL PRODUCTS

The equipment of the present invention provides the capability to utilize many diverse well know multileaf processing devices to produce products such as depicted in the sketches of FIG. VIII. For example, at A is a presentation of a square back magazine bound across the webs with wire stitches, and at B, a saddle type magazine again with the binding across the web. It is obvious other processing may be performed as depicted in sketch C of FIG. VIII, wherein a surgical drape is shown which would be processed by hole punching the large aperture, edge and transverse binding the webs and heat sealing the tabs on the outer web which with subsequent severing and folding result in the shown product. Of particular interest and great import is the product depicted a D, a saddle type magazine having the stitches in the running direction of the plurality of webs. It is apparent other method of processing and binding may be utilized such as nailing, adhesive thru binding, coil binding, hole drilling [as indicated in shetch B], inseting, imprinting etc.

OPERATION OF THE INVENTION

Referring to FIG. I a plurality of webs W1, W2, W3 . . . Wn are driven continuously from supply sources such as rolls R1, R2, R3 . . . Rn or other continuous web sources and are collated one above the other in register by means of conventional web collating equipment and are accepted by the web binder equipment denoted1, processed and transferred to the recipient web processing machinery of 3 which has severing means 4.

FIG. II provides a more detailed frontal illustration of the means of the invention. The plurality of webs W are guided around drums 5, 9 and rolls 7 and 8 forming two bights of webs each side of the processing location which is shown having stitching heads of the type manufactured by Bostitch mounted on framing 21 and driven by actuated bars 20.

Drum 5 has been provided with propeller 6 to insure continuous and uniform ingress of the webs W and is placed substantially along the normal to the webs travel to equalize the feed of all of the webs being processed. The webs are caused to wrap the drum and roll before the processing location equal amounts but in opposing directions as may better be seen in FIG. V. The reason being apparent when the register of the webs is considered, ie., spots S1, S2 . . . Sn are in register before contacting drum 5 and after wrapping it 180° are shingled out of register, however, the wrapping of roll 7 in the opposite direction returns the register of each of the webs to each other. The same disposition of drum and roll after the processing location provides for uniform egress of the webs without distorsion and further contributes to maintaining register and uniform tension of the portion of the webs Ws in the processing location. Returning to FIG. II, the webs path about rolls 7 and 8, it will be observed, will reamin of constant length regardless of the position of the rolls 7 and 8 as long as the center distance of the rolls is constant and they transverse an excursion parallel to the plane of the rolls 7 and 8. This is depicted by the rolls in positions 7A and 8A. Addressing attention to FIG. IV, which is a bottom view of FIG. II with the processing machinery not shown, the drums 5 and 9 are shown driven by gears 19 and 29 from gear 39 which is rotated by means of the line drive shaft 41 thru gear box 40. Shaft 41 serves to connect all the cooperating web supply sources and web driving means in synchronism. The drums 5 and 9 are rotatably mounted in the equipments frames 30 and 31 which are spaced apart. The rolls 7 and 8 are rotatably mounted in carriages 32 and 33 which are supported on guide rails 34 and 35 which are in turn secured to the frames 30 and 31. The carriages with the rolls 7 and 8 constitute a displaceable assembly which may be employed to increase the length of the webs before the processing location and to correspondently decrease the length of the webs after the location, ie., the length of the webs in the equipment will remain constant. As disclosed in the foregoing the disposition of the drums and the rolls will result in the length of each of the webs of the plurality of webs being of substantially the same length. It is apparent then, that the register of the webs and the tension of the webs is maintained in the processing location. In FIG. IV shafts 10 and 11 are rotatably mounted in the frames 30 and 31, and are driven by gears 18 and 38 which engage gears 19 and 29 respectively. A pair of conjugate cams are mounted on each shaft. The cams 14 and 14A drive the carriages from right to left and cams 15 and 15A drive the carriages from left to right. The cams 14 and 15, and 14A and 15A further cooperate to decelerate the carriages 32 and 33 and to maintain positive controls of the carriges' motion and therefore the motion of the webs in the processing location. Each of the carriages 32 and 33 are provided with cam roll followers 43 and 44 as shown.

Now then, selection of the proper transmission ratios [gears] will permit the carriages to be oscillated at a periodic rate correlated to images, or other characteristics, which repeat on the webs such as pages. Study of the motion of the web during the oscillation will disclose the webs are decelerated when the carriages are moved from left to right and when the velocity of the carriages [in this particular configuration of rolls and drums] is equal to half the webs speed the webs will cease to move in the processing location. Therefore I have designed the cams 14 and 15 to have a periphery with a constant rise per degree of rotation for a sufficient length of time to afford various processing operations such as stitching.

One of the problems in stitching a plurality of webs is to maintain the webs normal to the stitching wire legs for a sufficient length of time, without relative movement, to allow the legs of the stitch to enter & pass thru the plurality of webs and then to be clinched. Attention is directed to FIG. III which depicts the velocity imparted to the carriages 32 and 33 by the cams 14 and 15 as illustrated by the upper most curve. The center curve depicts the speed of the webs at the processing location, note the extended period of time at zero speed; and the lower curve which discloses the operation of the stitcher heads in which wire is formed into a U shape in the early stages of the mechanisms' stroke and enters the webs at $\alpha$ fully pentrates thru the webs at $\beta$ and is clinched at $\theta$.

While conjugate cams have been found perferred for the equipment built, it is obvious the art of machine design provides a number of alternates which may be optimun processing; alternate configurations of the invention as expressed in the appended claims.

Returning to the illustration of FIG. II, it should be understood the stitcher heads 22A and 22B are two rows of stitcher heads disposed transversely across the width of the webs Ws and in the embodiment depicted are stitching the webs along the backbones of two magazines. That is, the webs are being bound to make two magazines at a time. It will be realized at this point of the disclosure that the productivity of the machine may be increased by simultaneously binding a plurality of magazines along the length of the portion of the webs in the processing location. Thus in the machine depicted in the illustration of FIG. II two magazines were produced simultaneously and a easy running speed of 300 magazines per minute was attained.

The stitcher heads 22A and 22B are driven in the conventional manner by reciprocating the drive bars 20 by means of eccentrics 23 which are mounted on the rotatable drive shaft 25 and driven from drum 5 by means of gear pullies 24 and 26 with gear belt 27.

After binding the webs together, there occurs a problem in wrapping the plurality of bound webs around the drum 9 and roll 8. This problem is caused because the individual webs are prevented from slipping upon each other as described in the foregoing with reference to FIG. V. This problem may be overcome by providing the roll 8 and the drum 9 with a resilient covering of polyurethane foam or similar material which will move the bound portion of the webs and permit the intermediate portions to buckle inward. Another mode of resolving the problem consist in providing ribs on the roll 8 and drum 9 as illustrated in FIG. V. It is desirable to have the ribs made of a resilient material to permit the working radius of the ribs to adjust to the best diameter to transfer the webs dependent upon the number of webs being processed. In all cases it is advantageous to have the rolls 7 and 8 rotate with the substantially the same peripherial speed as the webs.

Focusing attention to FIG. IV and VI it will be observed I have provided sprockets on the shafts of drums 5 and 9 and on the shafts of rolls 7 and 8 for chain 76. Also provided is a chain takeup sprocket assembly 75. Since the chain passes around the sprockets 77, 78, 73 and 74 in the same direction and path as the webs it drives the rolls in synchronism with the webs and since I have further made roll 8 and drum 9 a multiple of the image repeat on the webs, the roll 8 and drum 9 rotate in timed synchronism with the binding of the webs so the ribs may be made to repeatly coincide with the bound part of the webs and avoid tear out of staples from the inner webs. In this manner the webs may buckle between the ribs in turning thru their bights and still maintain tension in each of the webs at the processing location. After leaving drum 9 the webs are taken by the recipient drum 37 which is provided with propeller 36. The drum 37 is rotatably mounted in the frames 30 and 31 and driven thru gear box 42 from the main drive shaft 41 at a surface speed substantially equal to that of drum 5. The drum 37 performs the further function of continuously driving the webs to the cooperating web severing means and the transverse folding means which are of conventional and well known design.

Referring to FIG. VII which presents an alternate construction of the invention and is arranged to bind webs in the running direction with staples and to perform other processng; a plurality of webs W1, W2....Wn are driven to the equipment by drum 53, having propeller 54, continuously at a constant speed. The drums 52 and 93 are rotatably mounted in spaced apart frames and the drums 72 and 83 are rotatably mounted in the displacable carriages 84 which are supported on the guides 85 which are mounted on the frames 86. The carriages 84 are reciprocated by the connecting links 87 driven by chains 88. It is apparent, as the end of link 87, which is rotatably afixed to the chain, transverses an excursion described by the chains' path that the end of the link will accelerate from an end position on a sprocket to a given speed and travel at that speed for the straight portion of the chains' path imparting constant speed to the carriages 84 and upon engaging the other sprocket will gradually decelerate and return to the starting position. As the drums 72 and 83 are displaced at constant speed concomitant with the speed of the webs toward 72A and 83A the webs will stop at the processing location between the drums 52 and 93. The chains 88 in addition to driving the carriages 84 at the necessary concomitant rate of speed also are constructed to excute reciprocation of the carriages 84 at a periodic rate correlated to the images on the web, which is also related to the webs driven speed. The chains 88 are driven from the main drive shaft of the machine by means not shown and the processing machinery 97 and 22G, 22H, 22J are driven from the same shaft with sprockets 90 and 98 and belt 94 thru the right angle gear box 99 and with shaft 96 to the stitcher 95. In the illustration of FIG. VII the webs Ws are stitched along the length of the webs by the stitcher heads and are also hole drilled with the hole drilling unit 97 which has been coupled to the drive from the stitcher 96. After the webs have been stitched together they are guided thru their bights to the recipient means. Drum 55 having propeller 56, continuously drives the webs from the equipment to the cooperating web severing means 57, packet accelerating rolls 58 and the chopper folder 59 which are of conventional and well know construction. The magazines produced, obviously are saddle type with columns running along the length of the web as printed on most web offset presses of today and having holes as may be used for multiple issue ring binding. It is apparent the present invention provides great flexibility in the processing equipment employed and in the mode in which it may be disposed to the webs and the desired product.

It will be apparent to those skilled in the art that the continuous control of the webs thruout the processing provides higher quality in many areas, for example, precise alignment of pages reducing the need for large trim allowances, accurate register of images on adjoining pages, etc. Still further, it is obvious the running speed in the net production speed and there is no need to vertify if all the pages are in the magazines.

Addressing the last illustration, FIG. IX, I have diagrammatically depicted a very high productivity form of the present invention. The webs enter the equipment as before at drum 16 which has propeller 66 and then is guided thru four bights before and after the processing location, ie., around drums 16, 47, 65 and 67 before the processing location and 68, 69, 48 and 49 after the location. The drums 67, 68, 47 and 48 are rotatably mounted in carriages 64 which are displaceable along guides 62 which are fastened to the frames 50. The carriages are reciprocated at a periodic rate correlated to the webs' speed and at a constant speed concomitant to the webs' speed. The means displacing the carriages is depicted as box cams 63 connected to the carriages with cam followers 61.

The drums 47, 65, 67, 68, 69, 48 and 49 are driven by chain in similar manner to that disclosed in FIG. VI in connection with the configuration of FIG. II.

The advantages of the configuration of FIG. IX resides in the greater number of bights in the webs which require lower concomitant speeds of the carriage for a given web speed. The configuration of FIG. IX when equipped with four sets of stitchers as illustrated is capable of processing 900 magazines per minute.

The webs after leaving the equipment are driven by drum 60 having propeller 70 and transferred to recipient means, such as, folder 79 and subsequently to the web severing means 80. Thereafter the magazines are trimmed by machinery at 12. The construction and details of the folders and severing means are conventional and well known to those skilled in the art. The invention of the equipment for controlling the excursion of the webs thru a processing location as disclosed facilitates the method of the present invention with its new, novel and very useful advantages and benefits.

I claim:

1. A method of processing a plurality of webs to produce multileaf products wherein said method comprises the steps of:

First, continuously driving at least two webs of material from supply sources thereof to a recipient of said web material Second, collating and registering each of said webs with each other Third, guiding said webs in an excursion to and thru a processing location intermediate of said supply sources and said recipient of said webs under substantially uniform tension wherein said webs excursion has at least one bight before said processing location and after said collation of all of said webs Fourth, stopping a portion of said webs at a periodic rate correlated to the driven speed of said webs and maintaining each of said webs in said portion of webs in register with each other at said processing location with places to be processed on said webs in alignment with processing means at said location Fifth, processing said stopped portion of said webs in at least one place Sixth, returning said stopped portion of said webs to web driving speed after said processing Seventh, guiding said processed webs from said processing location to said recipient of said webs thru an excursion having at least one bight after said processing location Eighth, severing said processed portion of said webs from said webs in predetermined locations with respect to said processed places on said webs thereby producing multileaf products.

2. A method of producing multileaf products of a class herein defined as magazines from a plurality of webs which comprises the steps of claim 1 with said processing location of step three having a binding means thereby in step eight producing said magazines.

3. A method of producing multileaf products of a class herein defined as saddle type magazines from a plurality of webs which comprises the steps of claim 2 wherein step five said binding means binds said webs along at least one line transversely disposed across said webs and in step eight said webs are severed having at least one page each side of said line of binding thereby producing bound multi-page packets and in addition thereto a ninth step which consists of folding said packets along said line of binding thereby producing saddle type magazines.

4. A method of producing multileaf products of a class herein defined as magazines for a plurality of webs which comprises the steps of claim 3 wherein said binding means comprises at least one stapling means.

5. A method of producing multileaf products of a class herein defined as magazines which comprises the steps of claim 2 wherein step 5 said binding means binds said webs along at least one line longitudinally disposed along said webs and in step eight said webs are severed having at least one page on each side of said line of binding thereby producing bound packets, and in addition thereto an additional ninth step consisting of folding said packets along said line of binding thereby producing saddle type magazines.

6. A method of producing multileaf products of a class herein defined as magazines from a plurality of webs which comprises the steps of claim 5 wherein said processing location of step 3 has at least one stapling means thereby binding said webs together in step 5 with staples.

7. A method of processing a plurality of webs to produce multileaf products which comprises the steps of claim 1 wherein the third step said webs are guided thru at least two bights before said processing location, and wherein the seventh step said processed webs are guided thru the same number of bights as in the third step, wherein the fourth step said webs are stopped by increasing the length of said webs excursion in said bights before said processing location and equally and inversely decreasing the length of said excursion of said processed webs in said bights after said processing location at a speed corresponding to the driving speed of said plurality of webs.

8. A method of processing a plurality of webs to produce multi-leaf products which comprises the steps of claim 1 wherein the fifth step said stopped portion of said webs is processed by binding said webs along at least one line longitudinally disposed along said webs.

9. Equipment for collectively processing a plurality of superimposed webs continuously driven to and from said equipment which comprises, in combination, means for guiding said plurality of webs to, thru and from a processing location, said guiding means directing the respective webs thru an excursion having at least one bight before and after said processing location, said guiding means having means to direct said webs collectively in substantially one plane while transversing said processing location, said guiding means having at least one displacable guide before and after said processing location; means for reciprocating said displacable guides, simultaneously relative to said processing location, thereby equally and inversely increasing and decreasing the lengths of said excursion of said webs excursion entering and leaving said processing location, said means for reciprocating said displacable guides operable at a periodic rate correlated to the driven speed of said plurality of webs, and means for imparting a velocity corresponding to the driven speed of said plurality of webs to said displacable guides so the movement of the portion of said webs transversing said processing location is stopped for a sufficient duration of time to permit processing said webs in conjunction with one another.

10. Equipment according to claim 9 with said guiding means comprising at least two drums rotatably mounted at fixed locations and said displacable guides comprising at least two rotatably mounted rolls for directing said plurality of webs thru said bights, said drums guiding said webs to and from said rolls, said drums and said rolls driven with peripherial speeds substantially equal to the speed of said webs contacting said drums and said rolls.

11. Equipment according to claim 10 with said rolls and drums which guide said webs after said processing location having means to accept said webs which have been processed and are traveling in a certain direction from said processing location, and means for directing said webs to an excursion away from said equipment in the same said certain direction; thereby removing any strain induced in said webs in traversing said bights after said processing location.

12. Equipment according to claim 10 with at least said rolls and said drums which guide said plurality of webs through said bights after said processing location having radially extending ribs spaced apart circumferentially and extending transversely across said rolls and said drums thereby producing spaces between said ribs, said ribs outermost periphery's acting as said rolls and said drums peripheries directing said plurality of webs through said bights in unison wherein individual webs of said plurality of webs tend to travel different distances in their excursion through said bights and unprocessed portions of said individual webs traveling through shorter distances may buckle into said spaces between said ribs of said rolls and said drums

13. Equipment according to claim 9 with said guiding means having means to accept said plurality of webs traveling in a certain direction to said equipment, and having means to guide said plurality of webs thru said processing location in the same certain direction; thereby essentially nullifying any flexure in said plurality of webs before entering said processing location.

14. Equipment according to claim 9 with said guiding means disposed to produce substantially equal lengths of said excursion of each of said webs of said plurality of webs in said equipment before said processing location.

15. Equipment according to claim 9 for processing a plurality of superimposed webs in which said processing location has at least one means for conjoining said webs with binding means disposed longitudinally and longitudinally spaced along the direction of travel of said plurality of webs; means for driving said conjoining means at a rate corresponding to the periodic rate of said reciprocating means and correlated to conjoin said webs while said portion of said plurality of webs has been stopped.

16. Equipment according to claim 9 for conjoining said plurality of webs in which said processing location has at least one means for conjoining said webs with binding means disposed transversely and transversely spaced across said plurality of webs and conjoining said webs transversely at predetermined intervals along the direction of travel of said webs; means for driving said conjoining means at a rate corresponding to the periodic rate of said reciprocating means and correlated to conjoin said webs while said portion of said plurality of webs has been stopped.

17. Equipment according to claim 9 with said guiding means comprising at least two drums rotatably mounted at fixed locations and said displacable guides comprising at least two rotatably mounted rolls for guiding said plurality of webs through said bights, said drums guiding said webs to and from said rolls.

18. Equipment according to claim 17 with at least said rolls and said drums which guide said plurality of webs through said bights after said processing location having resilient peripheries directing said plurality of webs through said bights in unison wherein individual webs of said plurality of webs tend to travel different distances in portions of their excursion through said bights, and said resilient peripheries are adapted to permit unprocessed portions of said individual webs traveling through shorter distances to buckle into said resilient peripheries of said rolls and said drums.

* * * * *